United States Patent [19]

Suzuki et al.

[11] 4,327,321

[45] Apr. 27, 1982

[54] CONSTANT CURRENT CIRCUIT

[75] Inventors: Hiroaki Suzuki, Tokyo; Michio Kurihara, Oita, both of Japan

[73] Assignee: Tokyo Shibaura Denki Kabushiki Kaisha, Japan

[21] Appl. No.: 158,521

[22] Filed: Jun. 11, 1980

[30] Foreign Application Priority Data

Jun. 19, 1979 [JP] Japan ..... 54-76278

[51] Int. Cl.[3] ..... G05F 3/08

[52] U.S. Cl. ..... 323/315; 307/304

[58] Field of Search ..... 323/312, 315–317; 330/288; 307/297, 304

[56] References Cited

U.S. PATENT DOCUMENTS

| | | | |
|---|---|---|---|
| 4,031,456 | 6/1977 | Shimada et al. | 323/315 |
| 4,048,590 | 9/1977 | Dobberpuhl | 330/288 |
| 4,230,980 | 10/1980 | Sano et al. | 323/315 |
| 4,281,261 | 7/1981 | Adam | 307/304 |

OTHER PUBLICATIONS

IEEE Journal of Solid-State Circuits, vol. SC-12, No. 3, pp. 224–231, Jun. 1977, (by E. Vittoz and J. Fellrath).

ESSCIRC 1976 Toulouse "New Analog CMOS IC's based on Weak Inversion Operation", by Eric Vittoz and Jean Fellrath.

*Primary Examiner*—William H. Beha, Jr.

*Attorney, Agent, or Firm*—Finnegan, Henderson, Farabow, Garrett & Dunner

[57] ABSTRACT

A constant current circuit is provided which is capable of feeding a constant current to a load connected in series with the source-drain path of a load drive MOSFET. The circuit employs a current mirror comprising first and second P channel MOSFETs, and first and second N channel MOSFETs connected in series with the first and second P channel MOSFETs, respectively. To avoid dependence on variations in power source voltage and/or threshold voltage characteristics of the MOSFETs, a resistor is inserted between the first P and N channel MOSFET's and the gate of the load drive MOSFET is coupled to both the junction of the resistor and first N channel MOSFET and to the gate of the second N channel MOSFET. Variations of this basic arrangement are also disclosed.

16 Claims, 11 Drawing Figures

FIG. 5
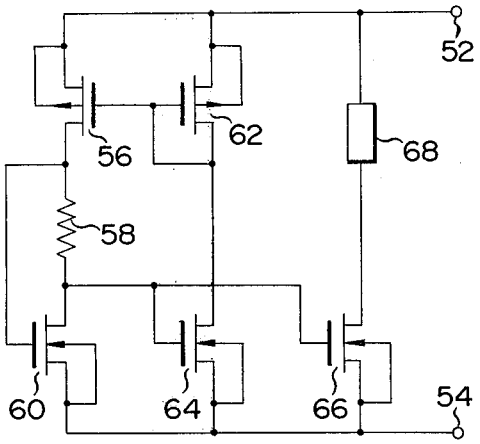
FIG. 6
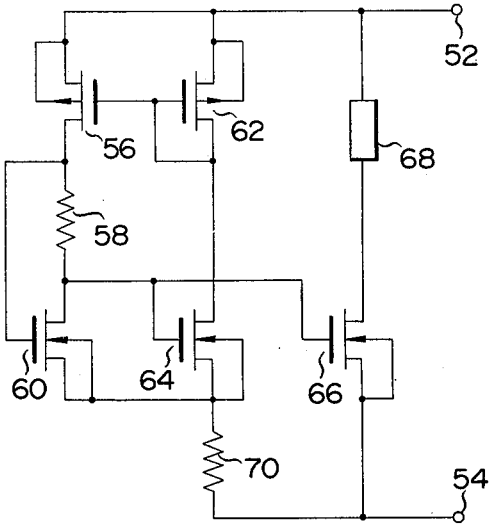
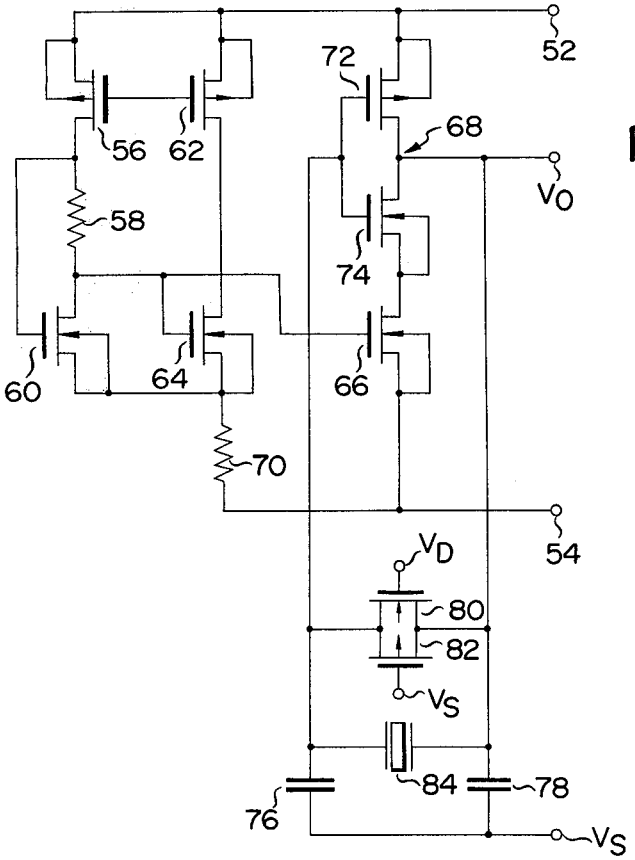
FIG. 7

CONSTANT CURRENT CIRCUIT

The present invention relates to a constant current circuit.

It is well known that a plurality of circuit components may be formed on a single semiconductor substrate in the form of an integrated circuit, and the integrated circuit, after being incorporated into an electronic clock circuit or a desk-top type calculator, may be driven by a battery or the like. In this case, in order to elongate the life time of the drive battery as long as possible, it is desirable to restrict the power consumption in the integrated circuit as small as possible. In the integrated circuit containing a constant current circuit, for example, it is required to minimize the power consumption in the constant current circuit so long as a proper circuit operation is ensured. When a dry cell is used for the drive power source, the output voltage of the dry cell greatly varies with lapse of time. When the power source voltage varies, it is desirable that the constant current circuit functions to provide a constant current. Also in a case where there is a variation in the threshold voltages of MOSFETs constituting the constant current circuit, it is required to keep constant the current fed by the constant current circuit.

To satisfy those requirements, there has been proposed a constant current circuit constructed as shown in FIG. 1, for example. The constant current circuit in FIG. 1 has a P channel MOSFET 10 which is connected at the source and substrate to the first power source terminal 2 and at the gate to the second power source terminal 4, and an N channel MOSFET 12 which is connected at the gate and drain commonly to the drain of the FET 10, and at the source to the second power source terminal 14. the drain of the N channel MOSFET 12 is coupled with the gate of an N channel MOSFET 14 which is connected at the drain to the first power source terminal 2 by way of a load 16, and at the substrate and the source to the second power source terminal 4.

In the constant current circuit shown in FIG. 1, when the power source voltage applied between the power source terminals 2 and 4 is fixed, a constant current flows into the drain of the FET 10. Since the FETs 12 and 14 constitute a current mirror, if the drain current of the FET 10 is constant, a constant current flows into the drain of the FET 14, too. As a result, the current flowing through the load 16 is made constant. When the power source voltage varies, however, a voltage between the source and gate of the FET 10 varies thereby to vary the drain current of the FET 10. The variation of the drain current of the FET 10 causes the gate potential and the drain potential of the FET 12 to vary. As a result, a current proportional to a channel constant S defined by the channel width/channel length of each FET flows into the FETs 12 and 14. Therefore, the current flowing through the load 16 also varies with the variation of the power source voltage.

The variation of the threshold voltages of the FETs is unavoidable due to the process of manufacturing semiconductor components. Because of the presence of the unavoidable variation of threshold voltages, when a number of FETs are integrated on a single semiconductor substrate, a constant current obtained in each constant current circuit will have a different value in accordance with the variation of the threshold voltages of the FETs.

A constant current circuit shown in FIG. 2 is so designed as to remedy the disadvantage of the constant current circuit of FIG. 1 in which the drain current of the FET 10 varies with the variation of the power source voltage. In the constant current circuit shown in FIG. 2, the enhancement type MOSFET 10 used in the circuit of FIG. 1 is replaced by a depletion type MOSFET 18. When the power source voltage varies, the voltage between the source and gate of the FET 18 in the constant current circuit of FIG. 2 is kept at 0 V, so that the drain current of the FET 18 does not change and consequently the drain current of the FET 14 little changes. A variation of the threshold voltages occurring in the manufacturing process, however, causes the desired constant current to change. The ordinary CMOS integrated circuit uses enhancement type MOSFETs. In constructing such CMOS integrated circuit, if a depletion type MOSFET is used for one of the FETs, the steps of the manufacturing process of the circuit must be increased correspondingly.

An example shown in FIG. 3 uses a resistor 20 in place of the FET 10 used in the constant current circuit shown in FIG. 1. In this circuit construction, the preset current values do not vary even if the threshold voltages of the FETs vary. However, when the power source voltage changes, the magnitude of the current flowing into the resistor 20 linearly changes, so that the current flowing into the load 16 also changes.

A constant current circuit designed to remedy the disadvantages of the constant current circuits of FIGS. 1 to 3 is illustrated in FIG. 4. As shown, the constant current circuit of FIG. 4 is comprised of a P channel MOSFET 22 and an N channel MOSFET 24, which are in series between the power source terminals 2 and 4, and a P channel MOSFET 26, an N channel MOSFET 28 and a resistor 30, which are connected in series between the power source terminals 2 and 4. The gate of the FET 22 is connected to the gate and the drain of the FET 26. The gate of the FET 28 is connected to the gate of an N channel MOSFET 14, and the gate and drain of the FET 24.

In the constant current circuit, the FET 14, in cooperation with the FETs 24 and 28, constitutes a current mirror circuit which feeds a constant current to the load 16.

Assume now that the channel constants of the FETs 22, 24, 26, 28 and 14, which are defined by the channel width/channel length of each of those FETs, are S22, S24, S26, S28 and S14, respectively. With those channel constants, when the constant current circuit is in a balanced state, the drain currents I1 and I2 of the FETs 22 and 26 are given by the following equations:

$$I1 = I_{C1} \cdot S24 \cdot e^{KV1} \quad (1)$$

$$I2 = I_{C1} \cdot S28 \cdot e^{K(V1 - I2 \cdot R30)} \quad (2)$$

where $I_{C1}$ is a constant, e is the base of a Napierian logarithm, K is a constant, V1 is a drain voltage of the FET 24, and R30 is a resistance of the resistor 30.

Since the FETs 22 and 26 constitute a current mirror circuit, the following relation between the currents I1 and I2 holds:

$$I2 = S26/S22 \cdot I1 \quad (3)$$

From the equations (1), (2) and (3), we have $$I2=1/(K\cdot R30)\cdot\log_e\{S28/S24\cdot S22/S26\} \quad (4)$$

When the voltage at the junction between the FETs 22 and 24 increasingly shifts from the value V1 obtained in a balanced state by ΔV1 which is caused by a disturbance, for example, the currents flowing through the FETs 22 and 24 respectively change from the value I1 obtained in a balanced state by ΔI11 and ΔI12, and the currents flowing through the FETs 26 and 28 change from the value I2 obtained in the balanced state by an amount ΔI2. In this case, the following equations hold:

$$\Delta I12=I_{C2}\cdot S24\cdot e^{K(V1+\Delta V1)}-I1\cong I1\cdot K\cdot\Delta V1 \quad (5)$$

$$\Delta I2=I_{C2}\cdot S28\cdot e^{K(V1+\Delta V1-I2\cdot R30-\Delta I2\cdot R30)}-I2\cong I2\cdot K(\Delta V1-\Delta I2\cdot R30) \quad (6)$$

$$\Delta/11=S22/S26\cdot\Delta I2 \quad (7)$$

where $I_{C2}$ is a constant. Changing the equation (6), we have $$\Delta I2=K\cdot\Delta V1\cdot I2/(1+K\cdot I2\cdot R30) \quad (8)$$

From the equations (5), (7) and (8), a gain of a loop including MOSFETs 22, 24 and 28 is expressed by $$\Delta I11/\Delta I12=\frac{S22}{S26}\cdot\frac{K\cdot\Delta V1\cdot I2}{1+K\cdot I2\cdot R30}\cdot\frac{1}{I1\cdot K\cdot\Delta V1} \quad (9)$$

$$=\frac{S22}{S26}\cdot\frac{1}{1+K\cdot I2\cdot R30}\cdot\frac{I2}{I1}$$

$$=\frac{1}{1+K\cdot I2\cdot R30}$$

$$=\frac{1}{1+\log_e(S28/S24\cdot S22/S26)}$$

In the equation (9), when S28/S24·S22/S26$>1$, ΔI11/ΔI12$<1$. The noise is attenuated while it travels the loop; however, it is impossible to reduce it to zero, in principle.

Accordingly, an object of the present invention is to provide a constant current circuit which is capable of feeding a constant current without being influenced by a variation of the power source voltage.

According to one aspect to the present invention, there is provided a constant current circuit comprising first and second MOS transistors with different channel types of which the current paths are connected in series between first and second power source terminals, a third MOS transistor of the same channel type as that of the first MOS transistor connected to the first power source terminal and the first MOS transistor and connected to form a constant current means in cooperation with the first MOS transistor, resistive means connected at the first terminal to the current path of the third MOS transistor and at the second terminal to the gate of the second MOS transistor, a fourth MOS transistor of the same channel type as that of said second MOS transistor whose gate is coupled with the first terminal of the resistor means and whose current path is connected to the second terminal of the resistor means and the second power source terminal, and a fifth MOS transistor whose gate is connected to one of the second terminal of the resistive means and the junction between the first and second MOS transistors and whose current path is connected in series with a load to which a constant current is supplied.

The present invention will be better understood from the following description taken in connection with the accompanying drawings, in which:

FIG. 5 is a circuit diagram of a constant current circuit according to an embodiment of the present invention;

FIG. 6 is a circuit diagram of a constant current circuit according to another embodiment of the present invention in which a variable range of the preset constant current is widened;

FIG. 7 is a circuit diagram of a constant current circuit which uses a crystal oscillating circuit as a load used in the constant current circuit shown in FIG. 6;

Figure 1:
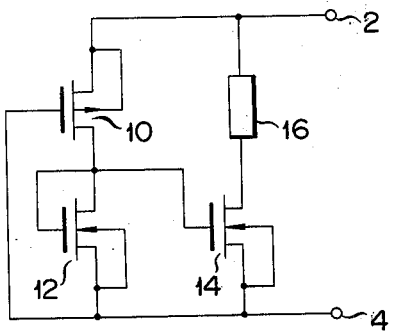
FIG. 1 PRIOR ART
FIG. 1 is a circuit diagram of a conventional constant current circuit constructed by using enhancement type MOSFETs.
Figure 2:
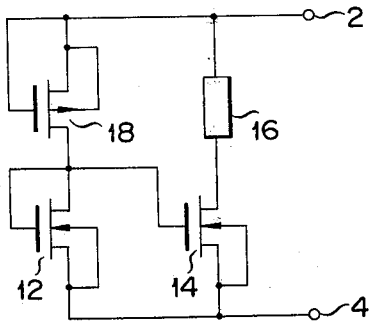
FIG. 2 PRIOR ART
FIG. 2 is a circuit diagram of another conventional constant current circuit in which one of the enhancement type MOSFETs used in the constant current circuit shown in FIG. 1 is replaced by a depletion type MOSFET.
Figure 3:
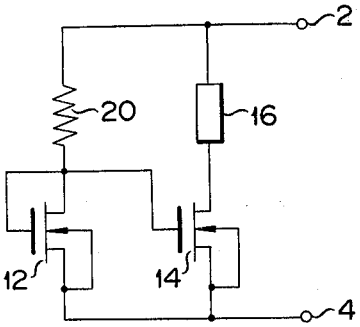
FIG. 3 PRIOR ART
FIG. 3 is a circuit diagram of yet another conventional constant current circuit in which one of the MOSFETs used in the constant current circuit shown in FIG. 1 is replaced by a resistor.

Reference is first made to FIG. 5 illustrating a constant current circuit according to an embodiment of the present invention. The constant current circuit shown in FIG. 5 has a series circuit including a P channel MOSFET 56, a resistor 58 and an N channel MOSFET 60, which is connected between positive and negative power source terminals 52 and 54. The resistor 58 is connected between FETs 56 and 60 of which the sources are respectively connected to the power source terminals 52 and 54. The gate of the FET 60 is coupled with the drain of the FET 56. Further connected between the power source terminals 52 and 54 is a series circuit of a P channel MOSFET 62 and an N channel MOSFET 64. The gate and drain of the FET 62 are coupled with the gate of the FET 56. The gate and drain of the FET 64 are coupled with the drain of the FET 60 and the drain of the FET 62, respectively. The drain of the FET 60 is coupled with the gate of an N channel MOSFET 66 which is connected at the drain to the power source terminal 52 through a load 68 and at the source to the power source terminal 54.

The FETs 56 and 62 cooperate to form a current mirror circuit and the FETs 64 and 66 cooperate to form a current mirror circuit.

Assume that, in the constant current circuit shown in FIG. 5 under a balanced condition, the drain currents flowing through FETs 56, 62 and 66 are $I_{D1}$, $I_{D2}$ and $I_{D3}$, and the channel constants of the FETs 56, 60, 62, 64 and 66 are S56, S60, S62, S64 and S66. On that assumption, the following relations hold:

$$I_{D1}=(S56/S62)I_{D2} \quad (10)$$

$$I_{D3}=(S66/S64)I_{D2} \quad (11)$$

The following relation holds between the gate voltages V60 and V64 of the FETs 60 and 64.

$$V64=V60-I_{D1}\cdot R58 \quad (12)$$

where R58 is a resistance of the resistor 58. When a gate voltage equal to the gate voltage V60 is applied to the gate of the FET 66, the drain current $I_{D4}$ flowing through the FET 64 is given by the following equation:

$$I_{D4}=S64/S60\cdot I_{D1}=S64/S60\cdot S56/S62\cdot I_{D2} \quad (13)$$

Arranging the equation (13), $I_{D2}/I_{D4}$ is given $$I_{D2}/I_{D4}=S60/S64\cdot S62/S56 \quad (14)$$

Therefore, the voltage drop across the resistor 58 causes the gate voltage of the FET 64 to drop below the gate voltage V60, so that a reduction rate of the drain current flowing through the FET 64 becomes equal to S60/S64·S62/S56. At this time, the constant current circuit enters a balanced state. In order to operate the circuit shown in FIG. 5 as a constant current circuit, S64/S60·S56/S62 must be larger than 1.

In the constant current circuit shown in FIG. 5, each enhancement type MOSFET therein is set so as to operate in the tailing operation region of a drain current-gate voltage characteristic, in principle. Thus, by using such a characteristic region that the drain current exponentially changes with respect to the gate voltage, it is possible to obtain a stable constant current circuit. For this reason, the explanation to follow will proceed on the assumption that the enhancement type MOSFETs operate in the tailing region of their operating characteristic.

The drain current $I_D$ of the MOSFET operating in the tailing region is generally expressed by $$I_D=I_C\cdot S\cdot e^{K(VG-VTH)} \quad (15)$$

where $I_C$ and K are each constant, S is the ratio of channel width/channel length, e is the base of a Napierian logarithm, $V_G$ is the gate voltage, and $V_{TH}$ is a threshold voltage.

If $I_0=I_C\cdot e^{-KVTH}$ the equation (15) is rewritten as follows:

$$I_D=I_0\cdot S\cdot e^{KVG} \quad (16)$$

From the equation (16), the drain currents $I_{D1}$, $I_{D2}$ and $I_{D3}$ of the FETs 60 and 64 obtained in the balanced state are expressed:

$$I_{D1}=I_0\cdot S60\cdot e^{KV60} \quad (17)$$

$$I_{D2}=I_0\cdot S64\cdot e^{KV64} \quad (18)$$

$$I_{D3}=I_0\cdot S66\cdot e^{KV64} \quad (19)$$

From the equations (10), (11), (12), (17), (18) and (19), we have the following equations:

$$I_{D1}=\frac{1}{K\cdot R58}\cdot \log_e(S64/S60\cdot S56/S62) \quad (20)$$

$$I_{D2}=(S62/S56)\frac{1}{K\cdot R58}\cdot \log_e(S64/S60\cdot S56/S62) \quad (21)$$

$$I_{D3}=(S66/S64)(S62/S56)\frac{1}{K\cdot R58}\cdot \log_e(S64/S60\cdot S56/S62) \quad (22)$$

As seen from the equations (20), (21) and (22), the drain current in the constant current circuit is independent of the threshold voltage of each MOSFET and the power source voltage as well, but depends on the ratio of the channel constants of respective FETs, the resistor 58 and the characteristic constant K (corresponding to an inclination of the characteristic curve in the tailing operation region) of each FET.

The explanation to follow is for a current changing rate when a noise, for example, is introduced into the constant current circuit.

Figure 4:
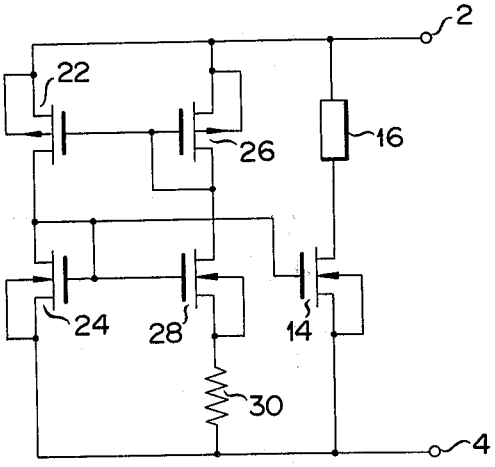
FIG. 4 PRIOR ART
FIG. 4 is a circuit diagram of still another conventional constant current circuit designed to solve the problems involved in the operations of the constant current circuits of FIGS. 1 to 3.

Assume that the noise introduced changes the drain voltage V56 of the FET 56 under a balanced condition by ΔV56. As described above relating to the constant current circuit shown in FIG. 4, the amounts of change of the drain currents of the FETs 60 and 56, denoted as $\Delta I_{D11}$ and $\Delta I_{D12}$, the amounts of change of the drain currents of the FETs 62 and 64, denoted as $I_{D2}$ and a loop gain $\Delta I_{D12}/\Delta I_{D11}$ are $$\begin{aligned}\Delta I_{D11} &= I_{C0}\cdot S60\cdot e^{K(V56+\Delta V56)}-I_{D1}\\ &\fallingdotseq I_{D1}\cdot K\cdot \Delta V56\end{aligned} \quad (23)$$

$$\begin{aligned}V64+\Delta V64 &= (V56+\Delta V56)-R58(I_{D1}+\Delta I_{D11})\\ &= V64+\Delta V56-R58\cdot \Delta I_{D11}\end{aligned} \quad (24)$$

$$\begin{aligned}\Delta I_{D2} &= I_{C0}\cdot S64\cdot e^{K(V64+\Delta V56-R58\cdot \Delta ID11)}I_{D2}\\ &\fallingdotseq I_{D2}\cdot K(\Delta V56-R58\cdot \Delta I_{D11})\\ &= I_{D2}\cdot K\cdot \Delta V56\{1-\log_e(S64/S60\cdot S56/S62)\}\end{aligned} \quad (25)$$

$$\begin{aligned}\Delta I_{D12} &= (S56/S62)\cdot \Delta I_{D2}\\ &= I_{D1}\cdot K(\Delta V56-R58\cdot \Delta I_{D11})\end{aligned} \quad (26)$$

$$\begin{aligned}\Delta I_{D12}/\Delta I_{D11} &= I_{D1}\cdot K(\Delta V56-R58\cdot \Delta I_{D11})/(I_{D1}\cdot K\cdot \Delta V56)\\ &= 1-\log_e(S64/S60\cdot S56/S62)\end{aligned} \quad (27)$$

When S64/S60·S56/S62=2.72, the loop gain for the noise may be reduced to zero. In this case, $\Delta I_{D2}$ is zero and the noise in the drain of the FET 56 has no influence on the drain current $I_{D2}$ of the FET 62. Therefore, the current flowing through the load 68 is also invariable. Thus, the stability of the operation against noise is effectively improved.

In the constant current circuit shown in FIG. 5, all the MOSFETs are operated in the trailing region, so that the constant current value to be set is limited to an extremely small, so that an extremely small current flows into the MOSFETs 56, 60, 62 and 64, which are other than the load. By adjusting the ratio of the channel constant ratio S66/S64, it is possible to adjust the amount of current flowing through the load 68 to some extent. Generally, the channel constant ratio S66/S64 is extremely large. Therefore, the range of a presettable constant current allowed to flow into the load 68 actually is restricted.

Turning now to FIG. 6, there is shown another embodiment of the constant current circuit according to the invention, in which the load current setting range may be set more widely than the constant current circuit shown in FIG. 5. The constant current circuit shown in FIG. 6 is the same as that of FIG. 5, except that a resistor 70 is connected between the source of the MOSFET 64 and the power source terminal 54.

In the constant current circuit shown in FIG. 6, the current $I_L$ flowing through the load 68 is given by the following equation:

$$I_L = (S66/S64 \cdot S62/S56) \times (S64/S60 \cdot S56/S62)^{R70/R58(1+S62/S56)} \times (1/K \cdot R58) \cdot \log_e(S64/S60 \cdot S56/S62) \quad (28)$$

From equations (22) and (28), we have $$I_L = (S64/S60 \cdot S56/S62)^{R70/R58(1+S62/S56)} \cdot I_{D3} \quad (29)$$

As seen from the above equation, the constant current circuit shown in FIG. 6 may obtain a constant current which may be set in a wider range than the circuit shown in FIG. 5. Also, in this case, the constant current is little influenced by a variation of the threshold voltage of each MOSFET used in the constant current circuit and a variation of the power source voltage.

A constant current circuit shown in FIG. 7 uses a crystal oscillator circuit as the load 68 in the constant current circuit shown in FIG. 6. In the constant current circuit shown in FIG. 7, the load 68 is comprised of MOSFETs 72 and 74 of P and N channel types having current paths connected in series between the power source terminal 52 and an MOSFET 66, a capacitor 76 connected between the gates of the MOSFETs 72 and 74 and a power source terminal Vs, a capacitor 78 connected between the power source terminal Vs and an output terminal Vo connected to the drains of the MOSFETs 72 and 74, an N channel MOSFET 80 connected at the gate to the power source terminal $V_D$ and a P channel MOSFET 82 connected at the gate to the power source terminal Vs, which are connected in parallel between the output terminal Vo and the gates of the MOSFETs 72 and 74, and a crystal resonator 84 connected between the output terminal Vo and the gates of the FETs 72 and 74.

In an ordinary crystal oscillator circuit, the dissipation current rapidly increases with increase of the power source voltage. Thus, it is very difficult to restrict the dissipation current to a small value. On the other hand, in the circuit shown in FIG. 7, when the power source voltage is changed from 1.0 V to 3.0 V, the increase of the dissipation current is merely about 20%. In this case, the value of the dissipation current may also be restricted to a small value. The result is that the power consumption is small.

Figure 8:
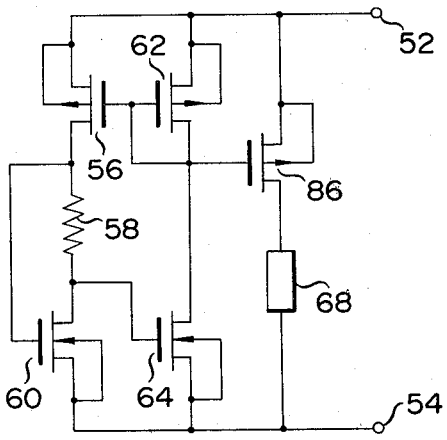
FIG. 8 is a circuit diagram of a modification of the constant current circuit shown in FIG. 5.

FIG. 8 shows a modification of the constant current circuit shown in FIG. 5. In the constant current circuit, a P channel MOSFET 86, in place of the N channel MOSFET 66, is coupled with the load 68. The gate of the P channel MOSFET 86 is coupled with the drain of a P channel MOSFET 62. The embodiment shown in FIG. 8 may also attain the effects similar to those achieved by the constant current circuit shown in FIG. 5.

While having been described by using some specific embodiments, the invention may be modified variously within the scope of the spirit of the invention.

Figure 9:
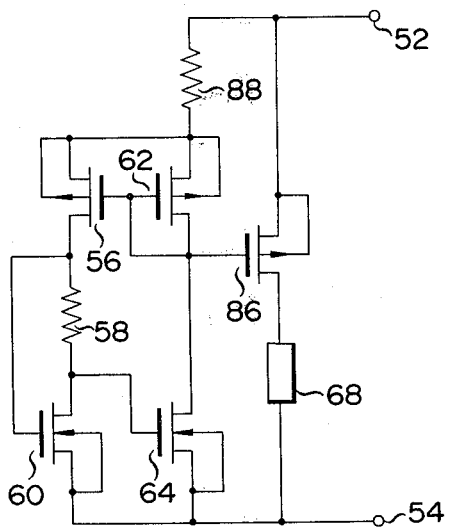
FIG. 9 is a circuit diagram of a modification of the constant current circuit shown in FIG. 8.

For example, in the constant current circuit shown in FIG. 8, a resistor 88 may be coupled between the power source terminal 52 and the sources of the MOSFETs 56 and 62 as shown in FIG. 9 in order to obtain a similar function to that of the resistor 70 of FIG. 6.

Figure 10:
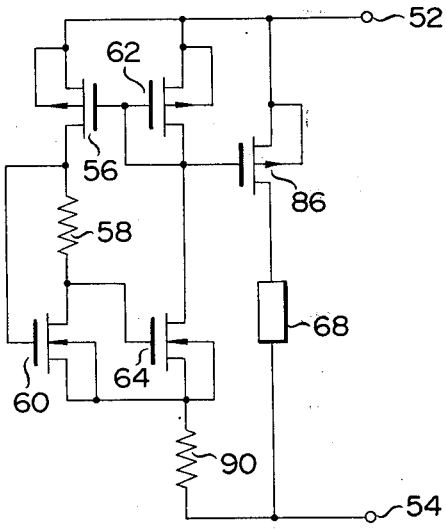
FIG. 10 is a circuit diagram of a modification of the constant current circuit shown in FIG. 9.

FIG. 10 shows a modification of the constant current circuit shown in FIG. 9, in which the resistor 88 used in the constant current circuit shown in FIG. 9 is removed and a resistor 90 is coupled between the source of an MOS transistor 64 of an N channel and the power source terminal 54. The constant current circuit shown in FIG. 10 operates in principle like the circuit shown in FIG. 9, thus having a similar effect.

Figure 11:
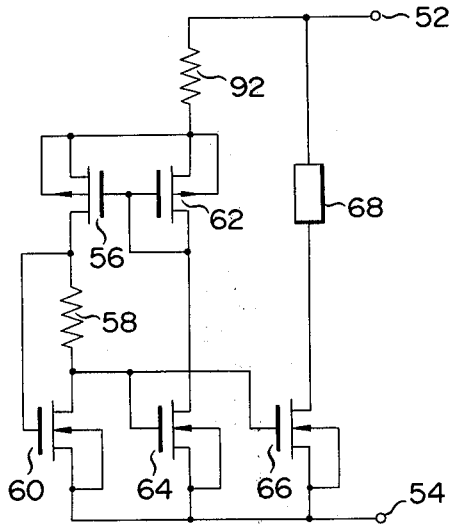
FIG. 11 is a circuit diagram of a modification of the constant current circuit shown in FIG. 6.

FIG. 11 shows a modification of the constant current circuit shown in FIG. 6. In this modification, the resistor 70 used in the constant current circuit shown in FIG. 6 is removed and a resistor 92 is coupled between the source of the N channel MOS transistor 64 and the power source terminal 54. The constant current circuit shown in FIG. 11 also operates in principle like the circuit shown in FIG. 6, and thus has a similar effect.

What we claim is:

1. A constant current circuit comprising:
first and second power source terminals;
first and second MOS transistors of different channel types connected to said first and second power source terminals, respectively, and having current paths which are connected in series between said first and second power source terminals;
a third MOS transistor of the same channel type as that of said first MOS transistor, which is connected to said first power source terminal and said first MOS transistor to form constant current means in cooperation therewith;
resistive means connected at the first terminal to said first power source terminal through the current path of said third MOS transistor, and at the second terminal to the gate of said second MOS transistor;
a fourth MOS transistor of the same channel type as that of said second MOS transistor whose gate is connected to said first terminal of said resistive means and whose current path is connected between the second terminal of said resistive means and said second power source terminal; and
a fifth MOS transistor of the same type as that of said second MOS transistor, which has a gate connected to the second terminal of said resistive means and a current path connected in series with a load to which a constant current is to be supplied.

2. A constant current circuit according to claim 1, wherein said first MOS transistor is a P channel MOS transistor.

3. A constant current circuit according to claim 1 or 2, wherein said fifth transistor is connected in series with said load between said first and second power source terminals.

4. A constant current circuit according to claim 3, wherein the sources of said second, fourth and fifth MOS transistors are commonly connected to said second power source terminal.

5. A constant current circuit according to claim 4, in which the sources of said first and third MOS transistors are commonly connected to each other and which further comprises resistive means connected between said first power source terminal and the sources of said first and third MOS transistors.

6. A constant current circuit according to claim 3, further comprising resistive means connected at one end to said second power source terminal and at the other end in series with the respective current paths of said second and fourth MOS transistors.

7. A constant current circuit according to claim 1, further comprising resistive means connected at one end to said second power source terminal and at the other end in series with the respective current paths of said second and fourth MOS transistors.

8. A constant current circuit according to claim 1, further comprising resistive means connected at one end to said first power supply terminal and at the other end to the respective sources of said first and third MOS transistors.

9. A constant current circuit comprising:

first and second power source terminals;

first and second MOS transistors of different channel types connected to said first and second power source terminals, respectively, and having current paths which are connected in series between said first and second power source terminals;

a third MOS transistor of the same channel type as that of said first MOS transistor, which is connected to said first power source terminal and said first MOS transistor and connected to said first MOS transistor to form constant current means in cooperation therewith;

resistive means connected at the first terminal to said first power source terminal through the current path of said third MOS transistor, and at the second terminal to the gate of said second MOS transistor;

a fourth MOS transistor of the same channel type as that of said second MOS transistor, which has a gate connected to said first terminal of said resistive means and a current path connected between the second terminal of said resistive means and said second power source terminal; and a fifth MOS transistor of the same type as that of said first MOS transistor, which has a gate connected to a junction between said first and second MOS transistors and a current path connected in series with a load to which a constant current is to be supplied.

10. A constant current circuit according to claim 9, wherein said first MOS transistor is a P channel type MOS transistor.

11. A constant current circuit according to claim 9 or 10, wherein said fifth MOS transistor is connected in series with said load between said first and second power source terminals.

12. A constant current circuit according to claim 11, wherein the sources of said first, third and fifth MOS transistors are commonly connected to said first power source terminal.

13. A constant current circuit according to claim 12, further comprising resistive means connected between said first power supply terminal and the sources of said first and third MOS transistors.

14. A constant current circuit according to claim 11, further comprising resistive means connected at one end to said first power source terminal and at the other end in series with the respective current paths to said first and third MOS transistors.

15. A constant current circuit according to claim 9, further comprising resistive means connected at one end to said first power source terminal and at the other end in series with the respective current paths of said first and third MOS transistors.

16. A constant current circuit according to claim 9, further comprising resistive means connected between said first power supply terminal and the sources of said first and third MOS transistors.

* * * * *